US006733538B1

(12) United States Patent
Panandiker et al.

(10) Patent No.: US 6,733,538 B1
(45) Date of Patent: May 11, 2004

(54) LAUNDRY DETERGENT COMPOSITIONS WITH CERTAIN CATIONICALLY CHARGED DYE MAINTENANCE POLYMERS

(75) Inventors: Rajan Keshav Panandiker, West Chester, OH (US); Sherri Lynn Randall, Hamilton, OH (US); Janet Sue Littig, Fairfield, OH (US); Eugene Paul Gosselink, Cincinnati, OH (US); David William Bjorkquist, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/914,524

(22) PCT Filed: Mar. 24, 2000

(86) PCT No.: PCT/US00/08031

§ 371 (c)(1),
(2), (4) Date: Aug. 29, 2001

(87) PCT Pub. No.: WO00/56849

PCT Pub. Date: Sep. 28, 2000

Related U.S. Application Data

(60) Provisional application No. 60/126,072, filed on Mar. 25, 1999.

(51) Int. Cl.[7] ..... D06L 1/00; C11D 1/00; C11D 3/37

(52) U.S. Cl. ..... 8/137; 510/360; 510/361; 510/434; 510/475; 510/476; 510/477; 510/480; 510/490; 510/500; 510/504

(58) Field of Search ..... 510/360, 361, 510/434, 475, 476, 477, 480, 490, 500, 504; 8/137

(56) References Cited

U.S. PATENT DOCUMENTS

| | | | | | |
|---|---|---|---|---|---|
| 4,371,517 | A | * | 2/1983 | Vanlerberghe et al. | 424/70 |
| 4,418,011 | A | * | 11/1983 | Bauman et al. | 252/544 |
| 4,772,462 | A | * | 9/1988 | Boothe et al. | 424/70 |
| 5,783,533 | A | | 7/1998 | Kensicher et al. | |
| 6,025,322 | A | * | 2/2000 | Boeckh et al. | 510/516 |
| 6,642,200 | B1 | * | 11/2003 | Zhang et al. | 510/475 |

FOREIGN PATENT DOCUMENTS

| | | | | | |
|---|---|---|---|---|---|
| DE | 196 49 288 | A1 | | 6/1998 | |
| EP | 0 754 748 | A1 | | 1/1997 | |
| EP | 754748 | | * | 1/1997 | C11D/3/00 |
| EP | WO 99/05248 | | * | 2/1999 | C11D/3/00 |
| EP | WO 00/56849 | | * | 9/2000 | C11D/3/00 |
| GB | 2 104 091 | A | | 3/1983 | |
| GB | 2104091 | | * | 3/1983 | C11D/3/37 |
| JP | 61031499 | A | | 2/1986 | |
| JP | 61031499 | | * | 2/1986 | C11D/1/38 |
| WO | WO 98/12292 | A1 | | 3/1998 | |
| WO | WO 98/16538 | A1 | | 4/1998 | |
| WO | WO 99/05248 | A1 | | 2/1999 | |
| WO | WO 00/22077 | A1 | | 4/2000 | |

OTHER PUBLICATIONS

M.Fred Hoover, Cationic Quaternary Polyelectrolytes– J. Marcomol. SCI.–Chem . . . A4(6). Pp. 1327–1417, Oct., 1970 Marcel Dekker, Inc.

* cited by examiner

*Primary Examiner*—Brian P. Mruk
(74) *Attorney, Agent, or Firm*—Laura R. Grunzinger; Kim W. Zerby; Steven W. Miller

(57) ABSTRACT

The present invention relates to laundry detergent compositions providing dye protection benefits to fabric comprising: a) from about 4% to about 70% by weight, of a surfactant; b) from about 0.01% by weight, of a dye maintenance polymer or oligomer, said polymer or copolymer comprising one or more linearly polymerizing monomers, cyclically polymerizing monomers, and mixtures thereof; and c) the balance carriers and adjunct ingredients.

10 Claims, No Drawings

LAUNDRY DETERGENT COMPOSITIONS WITH CERTAIN CATIONICALLY CHARGED DYE MAINTENANCE POLYMERS

This application claims priority to PCT application no. PCT/US00/08031, filed Mar. 24, 2000, and U.S. provisional application No. 60/126,072, filed Mar. 25, 1999.

FIELD OF THE INVENTION

The present invention relates to compositions, in either liquid or granular form, for use in laundry applications, wherein the compositions comprise certain dye maintenance polymers that have a net positive charge. Compositions comprising the dye maintenance polymers of this invention impart appearance and integrity benefits to fabrics and textiles laundered in washing solutions formed from such compositions.

BACKGROUND OF THE INVENTION

It is, of course, well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which could be added to laundry products that would associate themselves with the fibers of the fabrics and textiles laundered using such products and thereby reduce or minimize the tendency of the laundered fabric/textiles to deteriorate in appearance. Any such detergent product additive material should, of course, be able to benefit fabric appearance and integrity without unduly interfering with the ability of the laundry product to perform its intended function. The present invention is directed to the use of dye maintenance polymers in laundry applications that perform in this desired manner.

SUMMARY OF THE INVENTION

The present invention meets the aforementioned need in that it has been surprisingly discovered that fabric which is treated, and subsequently re-treated with the compositions of the present invention, will resist normal fading and color loss without regard to the circumstances, inter alia, due to mechanical wear and abrasion. In addition, fabric which has not been treated can have the loss of fabric dye attenuated by washing clothing with the laundry detergent compositions of the present invention. The compositions of the present invention can take any form, inter alia, heavy duty liquid (HDL), heavy duty granular (HDG), bars, pastes, thixotropic compositions.

The first aspect of the present invention relates to laundry detergent compositions providing dye protection benefits to fabric comprising:

a) from about 4% to about 70% by weight, of a surfactant selected from the group consisting of nonionic, anionic, cationic, amphoteric, zwitterionic surfactants and mixtures thereof, preferably at least one of said surfactants is an anionic surfactant;

b) from about 0.01%, preferably from about 0.1%, more preferably from about 0.5%, most preferably from about 0.8% to about 10%, preferably to about 8%, more preferably to about 6%, most preferably to about 5% by weight, of a dye maintenance polymer or oligomer, said polymer or copolymer comprising one or more units having the formula:

I) linear polymer units having the formula:

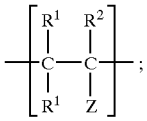

wherein each $R^1$ is independently
- a) hydrogen;
- b) $C_1$–$C_4$ alkyl;
- c) substituted or unsubstituted phenyl;
- d) substituted or unsubstituted benzyl;
- e) carbocyclic;
- f) heterocyclic;
- g) and mixtures thereof;

each $R^2$ is independently
- a) hydrogen;
- b) halogen
- c) $C_1$–$C_4$ alkyl;
- d) $C_1$–$C_4$ alkoxy;
- e) substituted or unsubstituted phenyl;
- f) substituted or unsubstituted benzyl;
- g) carbocyclic;
- h) heterocyclic;
- i) and mixtures thereof;

each Z is independently
- a) hydrogen;
- b) hydroxyl;
- c) halogen;
- d) $—(CH_2)_mR$;

wherein R is:
- i) hydrogen;
- ii) hydroxyl
- iii) halogen;
- iv) nitrilo;
- v) $—OR^3$;
- vi) $—O(CH_2)_nN(R^3)_2$;
- vii) $—O(CH_2)_nN^+(R^3)_3X^-$;
- viii) $—OCO(CH_2)_nN(R^3)_2$;
- ix) $—OCO(CH_2)_nN^+(R^3)_3X^-$;
- x) $—NHCO(CH_2)_nN(R^3)_2$;
- xi) $—NHCO(CH_2)_nN^+(R^3)_3X^-$;
- xii) $—(CH_2)_nN(R^3)_2$;
- xiii) $—(CH_2)_nN^+(R^3)_3X^-$;
- xiv) carbocyclic;
- xv) heterocyclic;
- xvi) nitrogen heterocycle quaternary ammonium;
- xvii) nitrogen heterocycle N-oxide;
- xviii) aromatic N-heterocyclic quaternary ammonium;
- xix) aromatic N-heterocyclic N-oxide;

xx) —NHCHO;

xxi) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6 e) $—(CH_2)_mCOR'$ wherein R' is i) $—OR^3$;

ii) $—O(CH_2)_nN(R^3)_2$;

iii) $—O(CH_2)_nN^+(R^3)_3X^-$;

iv) $—NR^3(CH_2)_nN(R^3)_2$;

v) $—NR^3(CH_2)_nN^+(R^3)_3X^-$;

vi) $—(CH_2)_nN(R^3)_2$;

vii) $—(CH_2)_nN^+(R^3)_3X^-$;

viii) or mixtures thereof;

each $R^3$ is independently hydrogen, $C_1$–$C_8$ alkyl, $C_2$–$C_8$ hydroxyalkyl, and mixtures thereof; X is a water soluble anion; the index n is from 0 to 6;

f) and mixtures thereof; the index m is from 0 to 6;

II) cyclic units derived from cyclically polymerizing monomers having the formula:

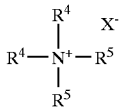

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion; and III) mixtures thereof; provided said polymer or co-polymer has a net cationic charge; and wherein said dye maintenance polymer is not an polyethyleneimine or alkoxylated derivative thereof; and b) the balance carriers and other adjunct ingredients.

In addition to the surfactant and the dye maintenance polymer of this invention, the laundry detergent compositions herein comprise from about 0.01% to 80% by weight of an organic or inorganic detergency builder and other conventional laundry detergent products. In its method aspect, the present invention relates to the laundering or treating of fabrics and textiles in aqueous washing, rinsing, or treating solutions formed from effective amounts of any of the detergent compositions, fabric softener compositions, or aqueous solution treatments described herein, or formed from the individual components of such compositions. Laundering of fabrics and textiles in such washing, rinsing and/or treatment solutions, followed by drying, imparts fabric appearance benefits to the fabric and textile articles so treated. Such benefits can include improved overall appearance, pill/fuzz reduction, anti-fading, improved abrasion resistance, and/or enhanced softness. It has been surprisingly determined that the dye maintenance polymers of this invention impart fabric appearance and integrity benefits that are greater than the benefits achieved by a corresponding amount of either component by itself.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

As noted, when fabric or textiles are laundered in solutions which comprise the dye maintenance polymers of the present invention fabric appearance and integrity are enhanced. The dye maintenance polymers can be added to wash solutions by incorporating them into a detergent composition, a fabric softener or by adding them separately to the washing solution. The dye maintenance polymers are described herein primarily as liquid or granular detergent additives but the present invention is not meant to be so limited. The dye maintenance polymers, detergent composition components, optional ingredients for such compositions and methods of using such compositions, are described in detail below. All percentages are by weight unless other specified.

Dye Maintenance Polymers

Compositions and systems of the present invention comprise from about 0.1%, preferably for about 1%, more preferably from about 2%, most preferably from about 3% to about 10%, preferably to about 7%, more preferably to about 5% by weight, of a polymer, co-polymer, or mixture thereof, wherein said polymer or co-polymer comprises at least one cationically charged unit, inter alia, quaternary ammonium moiety or unit which can form a cationic charge in situ, inter alia, primary amine moiety. Stated in another way, the oligomer, polymer, or co-polymer resulting from the herein below described monomer units must have a net cationic charge. The charge can be distributed among any of the herein described units.

The dye maintenance polymers of this invention can be used in any fabric laundering process and provide certain appearance benefits to the fabrics laundered in these processes. Such fabric appearance benefits can include, for example, improved overall appearance of the laundered fabrics, reduction of the formation of pills and fuzz, protection against color fading, improved abrasion resistance, etc. The dye maintenance polymers used in the compositions and methods herein can provide such fabric appearance benefits when incorporated in a wash or rinse added products.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. Copolymers are polymers or oligomers wherein two or more dissimilar monomers have been simultaneously or sequentially polymerized. Copolymers of the present invention can include, for example, polymers or oligomers copolymerizing acrylamide with dimethyldiallylammonium chloride, vinyl amine with vinyl alcohol, etc Cationic polymers in general and their method of manufacture are know. For example, a detailed description of cationic polymers can be found in an article by M. Fred Hoover that was published in the *Journal of Macromolecular Science—Chemistry,* A4(6), pp 1327–1417, October, 1970. The entire disclosure of the Hoover article is incorporated herein by reference. The dye maintenance polymers of this invention will be better understood when read in light of the Hoover article, the present disclosure and the Examples herein.

I) Linear Polymer Units

The polymers or co-polymers of the present invention can comprise one or more linear polymer units having the formula:

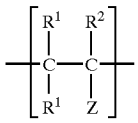

wherein $R^1$, $R^2$, and Z are defined herein below. Preferably, the linear polymer units are formed from linearly polymerizing monomers. Linearly polymerizing monomers are defined herein as monomers which under standard polymerizing conditions result in a linear polymer chain or alternatively which linearly propagate polymerization. The linearly polymerizing monomers of the present invention have the formula:

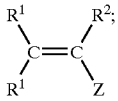

however, those of skill in the art recognize that many useful linear monomer units are introduced indirectly, inter alia, vinyl amine units, vinyl alcohol units, and not by way of linearly polymerizing monomers. For example, vinyl acetate monomers once incorporated into the backbone are hydrolyzed to form vinyl alcohol units. For the purposes of the present invention, linear polymer units may be directly introduced, i.e. via linearly polymerizing units, or indirectly, i.e. via a precursor as in the case of vinyl alcohol cited herein above.

Each $R^1$ is independently hydrogen, $C_1$–$C_4$ alkyl, substituted or unsubstituted phenyl, substituted or unsubstituted benzyl, carbocyclic, heterocyclic, and mixtures thereof. Preferably $R^1$ is hydrogen, $C_1$–$C_4$ alkyl, phenyl, and mixtures thereof, more preferably hydrogen and methyl.

Each $R^2$ is independently hydrogen, halogen, $C_1$–$C_4$ alkyl, $C_1$–$C_4$ alkoxy, substituted or unsubstituted phenyl, substituted or unsubstituted benzyl, carbocyclic, heterocyclic, and mixtures thereof. Preferred $R^2$ is hydrogen, $C_1$–$C_4$ alkyl, and mixtures thereof. Each Z is independently hydrogen; hydroxyl; halogen; —$(CH_2)_mR$, wherein R is hydrogen, hydroxyl, halogen, nitrilo, —$OR^3$, —$O(CH_2)_nN(R^3)_2$, —$O(CH_2)_nN^+(R^3)_3X^-$, —$OCO(CH_2)_nN(R^3)_2$, —$OCO(CH_2)_nN^+(R^3)_3X^-$, —$NHCO(CH_2)_nN(R^3)_2$, —$NHCO(CH_2)_nN^+(R^3)_3X^-$, —$(CH_2)_nN(R^3)_2$, —$(CH_2)_nN^+(R^3)_3X^-$, a non-aromatic nitrogen heterocycle comprising a quaternary ammonium ion, a non-aromatic nitrogen heterocycle comprising an N-oxide moiety, an aromatic nitrogen containing heterocyclic wherein one or more or the nitrogen atoms is quaternized; an aromatic nitrogen containing heterocycle wherein at least one nitrogen is an N-oxide; —NHCHO (formamide), or mixtures thereof; wherein each $R^3$ is independently hydrogen, $C_1$–$C_8$ alkyl, $C_2$–$C_8$ hydroxyalkyl, and mixtures thereof; X is a water soluble anion; the index n is from 0 to 6; carbocyclic, heterocyclic, or mixtures thereof; —$(CH_2)_mCOR'$ wherein R' is —$OR^3$, —$O(CH_2)_nN(R^3)_2$, —$O(CH_2)_nN^+(R^3)_3X^-$, —$NR^3(CH_2)_nN(R^3)_2$, —$NR^3(CH_2)_nN^+(R^3)_3X^-$, —$(CH_2)_nN(R^3)_2$, —$(CH_2)_nN^+(R^3)_3X^-$, or mixtures thereof, wherein $R^3$, X, and n are the same as defined herein above. A preferred Z is —$O(CH_2)_nN^+(R^3)_3X^-$, wherein the index n is 2 to 4. The index m is from 0 to 6, preferably 0 to 2, more preferably 0.

Non-limiting examples of linearly polymerizing monomers comprising a heterocyclic Z unit includes 1-vinyl-2-pyrrolidinone, 1-vinylimidazole, 2-vinyl-1,3-dioxolane, 4-vinyl-1-cyclohexene1,2-epoxide, and 2-vinylpyridine.

The polymers and co-polymers of the present invention comprise Z units which have a cationic charge or which result in a unit which forms a cationic charge in situ. When the co-polymers of the present invention comprise more than one Z unit, for example, $Z^1$, $Z^2$, . . . $Z^n$ units, at least about 1% of the monomers which comprise the co-polymers will comprise a cationic unit. Preferred cationic units include —$O(CH_2)_nN^+(R^3)_3X^-$ and —$(CH_2)_nN^+(R^3)_3X^-$. When the co-polymers of the present invention are formed from two monomers, $Z^1$ and $Z^2$, the ratio of $Z^1$ to $Z^2$ is preferably from about 9:1 to about 1:9.

A non-limiting example of a Z unit which can be made to form a cationic charge in situ is the —NHCHO unit, formamide. The formulator can prepare a polymer or co-polymer comprising formamide units some of which are subsequently hydrolyzed to form vinyl amine equivalents. For example the formulator may prepare a co-polymer having the general formula:

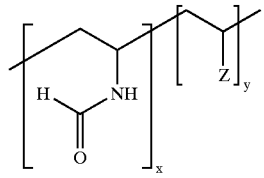

which comprises a formamide unit and then subsequently treat the co-polymer such that some of the formamide units are hydrolyzed to form a co-polymer comprising vinyl amine units, said polymer having the formula:

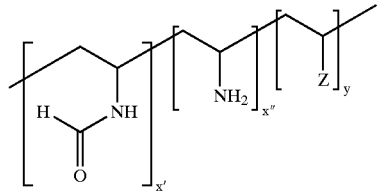

wherein Z may be a cationic unit comprising or non-cationic unit comprising moiety and x'+x"=x.

Another class of preferred linearly polymerizable monomers comprise cationically charged heteroaromatic Z units having the formula:

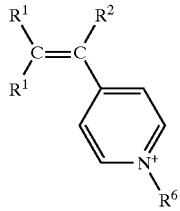

an non-limiting example of which is 4-vinyl (N-alkyl) pyridine wherein $R^1$ and $R^2$ are each hydrogen and $R^6$ is methyl.

Another class of preferred linearly polymerizable monomers which comprises a heterocyclic ring includes Z units comprising an N-oxide, for example, the N-oxide having the formula:

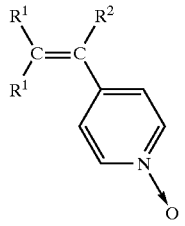

a non-limiting example of which is 4-vinyl pyridine N-oxide.

N-alkyl vinylpyridine monomers and N-oxide vinylpyridine monomers can be suitably combined with other non aromatic monomers, inter alia, vinyl amine. However, preferred polymers of the present invention include copolymers derived from a combination of quaternized, N-oxide, and nitrogen containing heteroaromatic monomers, non-limiting examples of which includes a copolymer of N-methyl vinyl pyridine and vinyl pyridine in a ratio of 4:1; a copolymer of N-methyl vinyl pyridine and vinyl pyridine in a ratio of 4:6; a co-polymer of poly(N-methyl vinyl pyridine) and vinyl pyridine N-oxide in a ratio of polymer to monomer of 4:1; poly(N-methyl vinyl pyridine) and vinyl pyridine N-oxide in a ratio of polymer to monomer of 4:6; and mixtures thereof.

A preferred linear co-polymer according to the present has the formula:

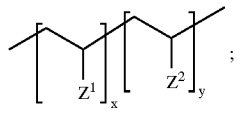

wherein $Z^1$ has the formula:

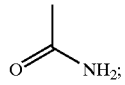

$Z^2$ has the formula:

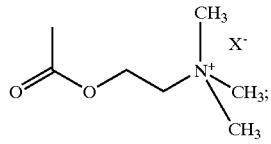

wherein X is chlorine; x has the value of from about 10 to about 100,000; y has the value of from about 10 to about 100,000; the ratio of x to y is from 9:1 to 1:9. Co-polymers of this type are available as, e.g., Sedipur® CF104 ex BASF. As described herein above, some preferred polymer residues may be formed by treatment of the resulting polymer. For example, vinyl amine residues are preferably introduced via formamide monomers which are subsequently hydrolyzed to the free amino unit. Also vinyl alcohol units are obtained by hydrolysis of residues formed form vinyl acetate monomers. Likewise, acrylic acid residues may be esterified after polymerization, for example, units having the formula:

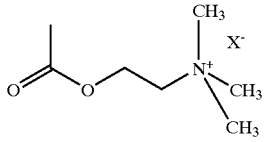

may be more conveniently formed after the backbone has been formed by polymerization with acrylic acid or acrylic acid precursor monomers.

II) Cyclic Units Derived from Cyclically Polymerizing Monomers

The polymers or co-polymers of the present invention can comprise one or more cyclic polymer units which are derived from cyclically polymerizing monomers. Cyclically polymerizing monomers are defined herein as monomers which under standard polymerizing conditions result in a cyclic polymer residue as well as serving to linearly propagate polymerization. Preferred cyclically polymerizing monomers of the present invention have the formula:

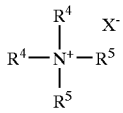

wherein each $R^4$ is independently an olefin comprising unit which is capable of propagating polymerization in addition to forming a cyclic residue with an adjacent $R^4$ unit; $R^5$ is $C_1$–$C_{12}$ linear or branched alkyl, benzyl, substituted benzyl, and mixtures thereof; X is a water soluble anion.

Non-limiting examples of $R^4$ units include allyl and alkyl substituted allyl units. Preferably the resulting cyclic residue is a six-member ring comprising a quaternary nitrogen atom.

$R^5$ is preferably $C_1$–$C_4$ alkyl, preferably methyl.

An example of a cyclically polymerizing monomer is dimethyl diallyl ammonium having the formula:

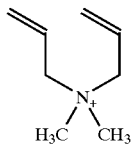

which results in a polymer or co-polymer having units with the formula:

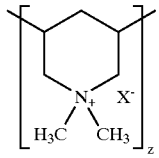

wherein preferably the index z is from about 10 to about 50,000.

III) Mixtures Thereof

The polymers or co-polymers of the present invention must retain a net cationic charge, whether the charged is developed in situ, or whether the polymer or co-polymer itself has a formal positive charge. Preferably the polymer or co-polymer has at least 10%, more preferably at least about 25%, more preferably at least about 35%, most preferably at least about 50% of the residues comprise a cationic charge.

The polymers or co-polymers of the present invention can comprise mixtures of linearly and cyclically polymerizing monomers, for example the poly(dimethyldiallylammonium chloride/acrylamide) co-polymer having the formula:

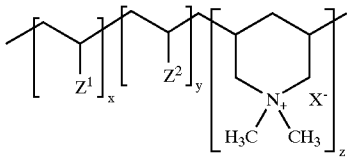

wherein $Z^1$, $Z^2$, x, y, and z are the same as defined herein above and X is chloride ion.

A particularly preferred embodiment of this invention is the composition comprising a polymer based on dimethyldiallylammonium chloride and a copolymer which is based upon acrylamide with a co-monomer selected from the group consisting of N,N dialkylaminoalkyl(meth)acrylate, N,N dialkylaminoalkylacrylate, N,N dialkylaminoalkylacrylamide, N,N dialkylaminoalkyl (meth)acrylamide, their quaternized derivatives and mixtures thereof.

Non-limiting examples of preferred polymers according to the present invention include dye maintenance copolymers comprising:

i) a first monomer selected from the group consisting of N,N dialkylaminoalkyl(meth)acrylate, N,N dialkylaminoalkylacrylate, N,N dialkylaminoalkylacrylamide, N,N dialkylaminoalkyl (meth)acrylamide, their quaternized derivatives and mixtures thereof; and ii) a second monomer selected from the group consisting of acrylic acid, methacrylic acid, $C_1$–$C_6$ alkylmethacrylate, $C_1$–$C_6$ alkyl acrylate, $C_1$–$C_8$ hydroxyalkylacrylate, $C_1$–$C_8$ hydroxyalkylmethacrylate, acrylamide, $C_1$–$C_{16}$ alkyl acrylamide, $C_1$–$C_{16}$ dialkylacrylamide, 2-acrylamido-2-methylpropane sulfonic acid or its alkali salt, methacrylamide, $C_1$–$C_{16}$ alkylmethacrylamide, $C_1$–$C_{16}$ dialkylmethacrylamide, vinyl formamide, vinylacetamide, vinyl alcohol, $C_1$–$C_8$ vinylalkylether, vinyl pyridine, itaconic acid, vinyl acetate, vinyl propionate, vinyl butyrate and mixtures thereof;

wherein the copolymer comprises at least 25 mole % of the first monomer.

Adjunct Ingredients

The compositions of the present invention may also optionally comprise one or more adjunct ingredients. Non-limiting examples of adjunct ingredients are selected from the group consisting of detersive surfactants, electrolytes, stabilizers, low molecular weight water soluble solvents, chelating agents, dispersibility aids, soil release agents, nonionic fabric softening agents, concentration aid, perfume, preservatives, colorants, optical brighteners, opacifiers, germicides, fungicides, anti-corrosion agents, antifoam agents, and mixtures thereof.

The following are applications which describe various detergent additive, methods of making these additives and methods of using them are all included herein by reference. WO 99/07813 A1 Randall et al., "Laundry Detergent Compositions with Amino Acid Based Polymers to Provide Appearance and Integrity Benefits to Fabrics Laundered Therewith"; WO 99/07814 A1 Randall et al., "Laundry Detergent Compositions with Amino Acid Based Polymers to Provide Appearance and Integrity Benefits to Fabrics Laudered Therewith"; WO 99/14299 A1 Panandiker et al., "Laundry Detergent Compositions with Anionically Modified, Cyclic Amine Based Polymers; WO 99/14300 A1 Panandiker et al., "Laundry Detergent Compositions with Cyclic Amine-Based Polymers to Provide Appearance and Integrity Benefits to Fabrics Laundered Therewith"; WO 99/14301 A1 Panandiker et al., "Laundry Detergent Compositions and Fabric Conditioning Compositions with Oxidized Cyclic Amine-Based Polymers"; and U.S. 99/23146 Panandiker et al., "Laundry Detergent Compositions with A Combination of Cyclic Amine Based Polymers and Hydrophobically Modified Carboxy Methyl Cellulose".

Surfactant System

The laundry detergent compositions of the present invention comprise a surfactant system. The surfactant systems of the present invention may comprise any type of detersive surfactant, non-limiting examples of which include one or more mid-chain branched alkyl sulfate surfactants, one or more mid-chain branched alkyl alkoxy sulfate surfactants, one or more mid-chain branched aryl sulfonate surfactants, one or more non mid-chain branched sulphonates, sulphates, cationic surfactants, zwitterionic surfactants, ampholytic surfactants, and mixtures thereof.

The total amount of surfactant present in the compositions of the present invention is from about 4% by weight, preferably from about 10% more preferably from about 15% to about 60%, preferably to about 30% by weight, of said composition.

Nonlimiting examples of surfactants useful herein include:

a) $C_{11}$–$C_{18}$ alkyl benzene sulfonates (LAS);

b) $C_6$–$C_{18}$ mid-chain branched aryl sulfonates (BLAS);

c) $C_{10}$–$C_{20}$ primary, α or ω-branched, and random alkyl sulfates (AS);

d) $C_{14}$–$C_{20}$ mid-chain branched alkyl sulfates (BAS);

e) $C_{10}$–$C_{18}$ secondary (2,3) alkyl sulfates as described in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

f) $C_{10}$–$C_{18}$ alkyl alkoxy sulfates ($AE_xS$) wherein preferably x is from 1–7;

g) $C_{14}$–$C_{20}$ mid-chain branched alkyl alkoxy sulfates ($BAE_xS$);

h) $C_{10}$–$C_{18}$ alkyl alkoxy carboxylates preferably comprising 1–5 ethoxy units;

i) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

j) $C_{14}$–$C_{22}$ mid-chain branched alkyl alkoxylates, $BAE_x$;

k) Alkylpolysaccharides as disclosed in U.S. Pat. No. 4,565,647 Llenado, issued Jan. 26, 1986, incorporated herein by reference;

l) Polyhydroxy fatty acid amides having the formula:

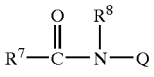

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_n CH_2OH$, $—CH(CH_2OH)(CHOH)_{n-1}CH_2OH$, $—CH_2(CHOH)_2(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

A non-limiting example of a nonionic surfactant suitable for use in the present invention has the formula:

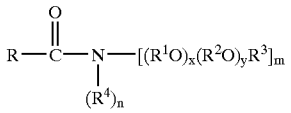

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof.

$R^1$ is ethylene; $R^2$ is $C_3$–$C_4$ linear alkyl, $C_3$–$C_4$ branched alkyl, and mixtures thereof; preferably $R^2$ is 1,2-propylene. Nonionic surfactants which comprise a mixture of $R^1$ and $R^2$ units preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units is from about 4:1 to about 8:1. Preferably an $R^2$ units (i.e. 1,2-propylene) is attached to the nitrogen atom followed by the balance of the chain comprising from 4 to 8 ethylene units.

$R^2$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a $—[(R^1O)_x(R^2O)_yR^3]$ unit.

The index m is 1 or 2, the index n is 0 or 1, provided that when m is equal to 1, n is equal to 1; and when m is 2 n is 0; preferably m is equal to 1 and n is equal to one, resulting in one $—[(R^1O)_x(R^2O)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

The mid-chain branched alkyl sulfate surfactants of the present invention have the formula:

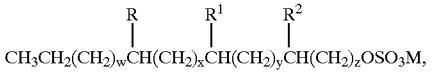

the alkyl alkoxy sulfates have the formula:

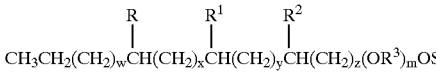

the alkyl alkoxylates have the formula:

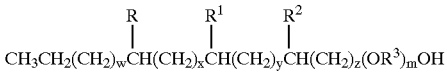

wherein R, $R^1$, and $R^2$ are each independently hydrogen, $C_1$–$C_3$ alkyl, and mixtures thereof; provided at least one of R, $R^1$, and $R^2$ is not hydrogen; preferably R, $R^1$, and $R^2$ are methyl; preferably one of R, $R^1$, and $R^2$ is methyl and the other units are hydrogen. The total number of carbon atoms in the mid-chain branched alkyl sulfate and alkyl alkoxy sulfate surfactants is from 14 to 20; the index w is an integer from 0 to 13; x is an integer from 0 to 13; y is an integer from 0 to 13; z is an integer of at least 1; provided w+x+y+z is from 8 to 14 and the total number of carbon atoms in a surfactant is from 14 to 20; $R^3$ is $C_1$–$C_4$ linear or branched alkylene, preferably ethylene, 1,2-propylene, 1,3-propylene, 1,2-butylene, 1,4-butylene, and mixtures thereof. However, a preferred embodiment of the present invention comprises from 1 to 3 units wherein $R^3$ is 1,2-propylene, 1,3-propylene, or mixtures thereof followed by the balance of the $R^3$ units comprising ethylene units. Another preferred embodiment comprises $R^3$ units which are randomly ethylene and 1,2-propylene units. The average value of the index m is at least about 0.01. When the index m has low values, the surfactant system comprises mostly alkyl sulfates with a small amount of alkyl alkoxy sulfate surfactant. Some tertiary carbon atoms may be present in the alkyl chain, however, this embodiment is not desired.

M denotes a cation, preferably hydrogen, a water soluble cation, and mixtures thereof. Non-limiting examples of water soluble cations include sodium, potassium, lithium, ammonium, alkyl ammonium, and mixtures thereof.

Detergent Builder

The detergent compositions herein may also comprise from about 0.1% to 80% by weight of a detergent builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al., U.S. Pat. No. 4,605,509, the disclosure of which is incorporated herein by reference. Also discussed in U.S. Pat. No. 4,605,509 are crystalline layered silicates which are suitable for use in the detergent compositions of this invention.

Optional Detergent Ingredients

In addition to the surfactants, builders and dye maintenance polymers of the detergent compositions of the present invention can also include any number of additional optional ingredients. These include conventional detergent composition components such as enzymes and enzyme stabilizing agents, suds boosters or suds suppressers, anti-tarnish and anticorrosion agents, bleaching agents, soil suspending agents, soil release agents, germicides, pH adjusting agents, non-builder alkalinity sources, chelating agents, organic and inorganic fillers, solvents, hydrotropes, optical brighteners, dyes and perfumes.

pH adjusting agents may be necessary in certain applications where the pH of the wash solution is greater than about 10.0 because the fabric integrity benefits of the defined compositions begin to diminish at a higher pH. Hence, if the wash solution is greater than about 10.0 after the addition of the dye maintenance polymers of the present invention a pH adjuster should be used to reduce the pH of the washing solution to below about 10.0, preferably to a pH of below about 9.5 and most preferably below about 7.5. Suitable pH adjusters will be known to those skilled in the art.

A preferred optional ingredients for incorporation into the detergent compositions herein comprises a bleaching agent, e.g., a peroxygen bleach. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used, generally in particulate form, in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonate, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms. $R^2$ is an alkylene containing from 1 to about 6 carbon atoms, $R^5$ is H or alkyl, aryl or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanamidocaproyl) oxybenzenesul-fonate, (6-decanamido-caproyl)oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966,723, Issued Oct. 30, 1990, incorporated herein by reference. See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If utilized, peroxygen bleaching agent will generally comprise from about 2% to 30% by weight of the detergent compositions herein. More preferably, peroxygen bleaching agent will comprise from about 2% to 20% by weight of the compositions. Most preferably, peroxygen bleaching agent will be present to the extent of from about 3% to 15% by weight of the compositions herein. If utilized, bleach activators can comprise from about 2% to 10% by weight of the detergent compositions herein. Frequently, activators are employed such that the molar ratio of bleaching agent to activator ranges from about 1:1 to 10:1, more preferably from about 1.5:1 to 5:1.

Additional suitable bleaching agents and bleach activators are disclosed in one or more of the co-pending PCT Applications listed in Table A and incorporated herein by reference.

Another highly preferred optional ingredient in the detergent compositions herein is a detersive enzyme component. Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability, optimal thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry detergent composition. Preferred enzymes for laundry purposes include, but are not limited to, proteases, cellulases, lipases, amylases and peroxidases.

Enzymes are normally incorporated into detergent compositions at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. Higher active levels may be desirable in highly concentrated detergent formulations.

Cellulases usable herein include those disclosed in U.S. Pat. No. 4,435,307, Barbesgoard et al., Mar. 6, 1984, and GB-A-2.075.028; GB-A-2.095.275 and DE-OS-2.247.832. CAREZYME® and CELLUZYME® (Novo) are especially useful. See also WO 9117243 to Novo.

The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

Detergent Composition Preparation

The detergent compositions according to the present invention can be in liquid, paste or granular form. Such compositions can be prepared by combining the essential and optional components in the requisite concentrations in any suitable order and by any conventional means. The forgoing description of uses for the dye maintenance polymers defined herein are intended to be exemplary and other uses will be apparent to those skilled in the art and are intended to be within the scope of the present invention.

Granular compositions, for example, are generally made by combining base granule ingredients, e.g., surfactants, builders, water, etc., as a slurry, and spray drying the resulting slurry to a low level of residual moisture (5–12%). The remaining dry ingredients, e.g., granules of the essential dye maintenance polymers, can be admixed in granular powder form with the spray dried granules in a rotary mixing drum. The liquid ingredients, e.g., solutions of the essential dye maintenance polymers, enzymes, binders and perfumes, can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents. Addition of the dye maintenance polymers to liquid detergent or other aqueous compositions of this invention may be accomplished by simply mixing into the liquid solutions the desired dye maintenance polymers.

Fabric Laundering Method

The present invention also provides a method for laundering fabrics in a manner which imparts fabric appearance benefits provided by the dye maintenance polymers used herein. Such a method employs contacting these fabrics with an aqueous washing solution formed from an effective amount of the detergent compositions hereinbefore described or formed from the individual components of such compositions. Contacting of fabrics with washing solution will generally occur under conditions of agitation although the compositions of the present invention may also be used to form aqueous unagitated soaking solutions for fabric cleaning and treatment. As discussed above, it is preferred that the washing solution have a pH of less than about 10.0, preferably it has a pH of about 9.5 and most preferably it has a pH of about 7.5.

Agitation is preferably provided in a washing machine for good cleaning. Washing is preferably followed by drying the wet fabric in a conventional clothes dryer. An effective amount of a high density liquid or granular detergent composition in the aqueous wash solution in the washing machine is preferably from about 500 to about 7000 ppm, more preferably from about 1000 to about 3000 ppm.

EXAMPLES

The following examples illustrate the compositions and methods of the present invention, but are not necessarily meant to limit or otherwise define the scope of the invention.

Example I

TABLE I comprises numerous examples according to the present invention along with some comparative examples of material known to the art of laundry detergents. The chemical structures shown in the examples below are idealized structures. Side reactions expected to occur during the condensation are not shown.

TABLE II

| Ex. # | Material |
|---|---|
| 1 | Poly(N,N dimethylaminoethyl methacrylate) |
| 2 | Poly(N,N dimethylaminoethyl methacrylate), MW 9700 |
| 3 | Poly(N,N dimethylaminoethyl methacrylate), MW 15,700 |
| 4 | Poly(N,N dimethylaminoethyl methacrylate), MW 39,700 |
| 5 | Poly(N,N dimethylaminoethyl methacrylate-co-dimethylacrylamide) ratio 1:1 MW 13670 |
| 6 | Poly(N,N dimethylaminoethyl methacrylate-co-dimethylacrylamide) ratio 2:1, MW 14,400 |
| 7 | Poly(N,N dimethylaminoethyl methacrylate-co-dimethylacrylamide) ratio 3:1 MW 16,300 |
| 8 | Methyl quat of poly(N,N dimethylaminoethyl methacrylate) |
| 9 | Amine oxide of Poly(N,N dimethylaminoethyl methacrylate) |
| 10 | Poly(N,N dimethylaminoethylmethacrylate-co-octylacrylamide) ratio 3:1, MW = 6730 |
| 11 | Poly(N,N dimethylaminoethyl methacrylate-co-acrylic acid) ratio 1:1, MW = 14,950 |
| 12 | Poly(N,N dimethylaminoethyl methacrylate-acrylamide) ratio 1:1, Poly(N,N dimethylaminoethyl methacrylate-propane sultone) ratio 1:1, |
| 13 | Poly(dimethyldiallylammonium chloride) sold under the trade name Merquat 100 by Calgon Corporation, Pittsburg, PA. |
| 14 | Poly(dimethyldiallylammonium chloride-co-acrylamide) sold under the trade name Merquat Plus (Calgon Corporation, Pittsburg, PA). |
| 15 | Poly(dimethyldiallylammonium chloride-co-acrylamide) sold under the trade name Merquat 550 (Calgon Corporation, Pittsburg, PA). |
| 16 | Poly(dimethyldiallylammonium chloride-co-acrylic acid) sold under the trade name Merquat 280 (Calgon Corporation, Pittsburg, PA). |
| 17 | Poly(N methyl,N octadecyl aminoethyl methacrylate) quaternized with dimethyl sulfate (CTFA nomenclature polyquaternium 8) |
| 18 | Ionene polymer of N,N,N',N' tetramethyl hexanediamine and 1,6 dibromohexane in the ratio 4:3 |
| 19 | Polyvinylamine |
| 20 | Poly(vinylamine-co-vinylalcohol) ratio 1:1 |
| 21 | Poly(vinylamine-co-acrylic acid) ratio 1:1 |
| 22 | Polyallylamine |
| 23 | poly(vinylamine-co-vinyl formamide) ratio 1:1 |
| 24 | polyvinylamine ethoxylated with 0.5 moles of ethylene oxide per N—H |
| 25 | polyvinylamine propoxylated with 0.5 moles of propylene oxide per N—H |
| 26 | Polyquaternium 2 (CTFA nomenclature) sold under the trade name Mirapol A15 by Rhone Poulenc, Paris, France. |
| 27 | Polyquaternium 17 (CTFA nomenclature) sold under the trade name Mirapol AD-1 by Rhone Poulenc, Paris, France. |
| 28 | Copolymer of N methylvinyl pyridine co-vinyl pyridine (ratio 4:1) |
| 29 | Copolymer of N methylvinyl pyridine co-vinyl pyridine (ratio 4:6) |
| 30 | Poly(N methylvinyl pyridine co-vinyl pyridine N oxide) ratio 4:1 |
| 31 | Poly(N methylvinyl pyridine co-vinyl pyridine N oxide) ratio 4:6 |

Example II

Granular Detergent Test Composition Preparation

Several heavy duty granular detergent compositions are prepared containing one or more dye maintenance polymer having a DMP according to this invention. These granular detergent compositions all have the following basic formula:

TABLE II

| Component | Wt. % |
|---|---|
| $C_{12}$ Linear alkyl benzene sulfonate | 9.31 |
| $C_{14-15}$ alkyl ether (0.35 EO) sulfate | 12.74 |
| Zeolite Builder | 27.79 |
| Sodium Carbonate | 27.31 |
| PEG 4000 | 1.60 |
| Dispersant | 2.26 |

TABLE II-continued

| Component | Wt. % |
|---|---|
| $C_{12-13}$ Alcohol Etholylate (9 EO) | 1.5 |
| Sodium Perborate | 1.03 |
| Soil Release Polymer | 0.41 |
| Enzymes | 0.59 |
| Dye Maintenance Polymer | 3.0 |
| Perfume, Brightener, Suds Suppressor, Other Minors, Moisture, Sulfate | Balance |
| | 100% |

Example III

Liquid Detergent Test Composition Preparation

Several heavy duty liquid detergent compositions are prepared containing one or more dye maintenance polymer having a DMP according to this invention. These liquid detergent compositions all have the following basic formula:

TABLE III

| Component | Wt. % |
|---|---|
| $C_{12-15}$ alkyl ether (2.5) sulfate | 38 |
| $C_{12}$ glucose amide | 6.86 |
| Citric Acid | 4.75 |
| $C_{12-14}$ Fatty Acid | 2.00 |
| Enzymes | 1.02 |
| MEA | 1.0 |
| Propanediol | 0.36 |
| Borax | 6.58 |
| Dispersant | 1.48 |
| Na Toluene Sulfonate | 6.25 |
| Dye Maintenance Polymer | 1.0 |
| Dye, Perfume, Brighteners, Preservatives, Suds Suppressor, Other Minors, Water | Balance |
| | 100% |

Example IV

Granular Detergent Test Composition Preparation

Several granular detergent compositions are prepared containing one or more dye maintenance polymer having a DMP according to this invention. Such granular detergent compositions all have the following basic formula:

TABLE IV

| Component | Example Wt. % | Comparative Wt. % |
|---|---|---|
| Na $C_{12}$ Linear alkyl benzene sulfonate | 9.40 | 9.40 |
| Na $C_{14-15}$ alkyl sulfonate | 11.26 | 11.26 |
| Zeolite Builder | 27.79 | 27.79 |
| Sodium Carbonate | 27.31 | 27.31 |
| PEG 4000 | 1.60 | 1.60 |
| Dispersant, Na polyacrylate | 2.26 | 2.26 |
| $C_{12-13}$ alkyl etholylate (E9) | 1.5 | 1.5 |
| Sodium Perborate | 1.03 | 1.03 |
| Dye Maintenance Polymer | 0.8 | 0 |
| Other Adjunct ingredients | Balance | Balance |
| | 100% | 100% |

What is claimed is:

1. A detergent compositions comprising:

a) from about 4% to about 70% by weight, of a surfactant;

b) from about 0.01% to about 10% by weight, of a dye maintenance co-polymer, said copolymer having the general formula:

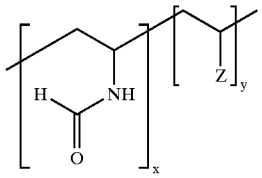

x has the value of from about 10 to about 100,000; y has the value of from about 10 to about 100,000; the ratio of x to y is from 9:1 to 1:9; each Z is independently a heterocycling ring containing an N-oxide, a cationically charged heteroaromatic monomer, a cyclically polymerizing monomer, or $(CH_2)_mCOR'$, wherein R' is selected from:

i) $—OR^3$;

ii) $—O(CH_2)_nN(R^3)_2$;

iii) $—O(CH_2)_nN^+(R^3)_3X^-$;

iv) $—NR^3(CH_2)_nN(R^3)_2$;

v) $—NR^3(CH_2)_nN^+(R^3)_3X^-$;

vi) $—(CH_2)_nN(R^3)_2$;

vii) $—(CH_2)_nN^+(R^3)_3X^-$;

viii) or mixtures thereof;

each $R^3$ is independently hydrogen, $C_1$–$C_8$ alkyl, $C_2$–$C_8$ hydroxyalkyl, and mixtures thereof; X is a water soluble anion;

the index n is from 0 to 6; the index m is from 0 to 6;

provided said polymer or co-polymer has a net cationic charge; and wherein said dye maintenance polymer is not an polyethyleneimine or alkoxylated derivative thereof; and c) the balance carriers and other adjunct ingredients.

2. A composition according to claim 1 comprising from about 0.1% to about 7% by weight of said dye maintenance polymer.

3. A composition according to claim 1 wherein Z has the formula:

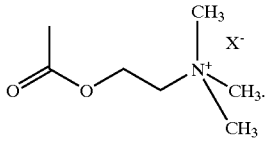

4. A composition according to claim 1 wherein comprises a cyclically polymerizing monomer, said cyclically polymerizing monomer having the formula:

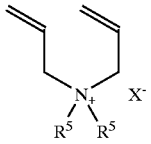

wherein $R^5$ is $C_1$–$C_4$ alkyl, and mixtures thereof; X is a water soluble anion.

5. A composition according to claim 1 comprising a co-polymer wherein Z has the formula:

$$—(CH_2)_mCOR'$$

wherein each R' is independently $—O(CH_2)_nN(R^3)_2$; $—O(CH_2)_nN^+(R^3)_3X^-$; $—(CH_2)_nN(R^3)_2$; $—(CH_2)_nN^+(R^3)_3X^-$; and mixtures thereof; m is 0, n is from 2 to 4.

6. A composition according to claim 1 comprising a co-polymer wherein the co-polymer further comprises vinyl amine units having the formula:

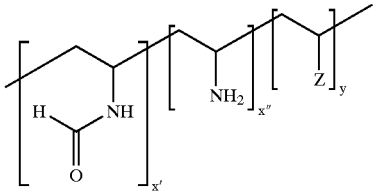

wherein x'+x"=x.

7. A composition according to claim 1 wherein Z comprises a cationically charged heteroaromatic monomer, said cationically charged heteroaromatic monomer having the formula:

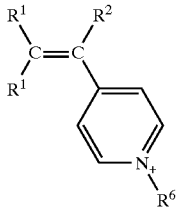

wherein $R^1$ and $R^2$ are each hydrogen and $R^6$ is methyl.

8. A composition according to claim 1 wherein Z comprises a heterocyclic ring containing an N-oxide, said heterocyclic ring containing an N-oxide having the formula:

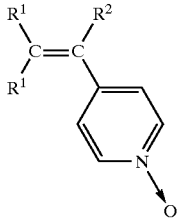

wherein $R^1$ and $R^2$ are each hydrogen.

9. A composition according to claim 1 wherein said adjunct ingredients are selected from the group consisting of electrolytes, stabilizers, low molecular weight water soluble solvents, chelating agents, dispersibility aids, soil release agents, nonionic fabric softening agents, concentration aid, perfume, preservatives, colorants, optical brighteners, opacifiers, germicides, fungicides, anti-corrosion agents, antifoam agents, and mixtures thereof.

10. A method for reducing the loss of fabric dye comprising the steps of:

i) contacting dyed fabric with a laundry detergent comprising:

a) from about 4% to about 70% by weight, of a surfactant;

b) from about 0.01% to about 5% by weight, of a dye maintenance copolymer of claim 1; and c) the balance carriers and other adjunct ingredients; and ii) agitation; and iii) optionally, drying the fabric.

* * * * *